US012747898B2

(12) United States Patent
Nakao et al.

(10) Patent No.: US 12,747,898 B2
(45) Date of Patent: Sep. 29, 2026

(54) REFRIGERANT CIRCULATION SYSTEM

(71) Applicant: Mazda Motor Corporation, Aki-gun (JP)

(72) Inventors: Yusuke Nakao, Aki-gun (JP); Yuma Miyauchi, Aki-gun (JP); Yoshitomo Takahashi, Aki-gun (JP)

(73) Assignee: Mazda Motor Corporation, Aki-gun (JP)

( * ) Notice: Subject to any disclaimer, the term of this patent is extended or adjusted under 35 U.S.C. 154(b) by 86 days.

(21) Appl. No.: 19/041,051

(22) Filed: Jan. 30, 2025

(65) Prior Publication Data

US 2025/0277611 A1 Sep. 4, 2025

(30) Foreign Application Priority Data

Mar. 4, 2024 (JP) ..... 2024-032192

(51) Int. Cl.

| | |
|---|---|
| ***F25B 43/02*** | (2006.01) |
| ***F01M 1/10*** | (2006.01) |
| ***F01M 1/16*** | (2006.01) |
| ***F01M 11/12*** | (2006.01) |

(Continued)

(52) U.S. Cl.

CPC ..... *F25B 43/02* (2013.01); *F01M 1/10* (2013.01); *F01M 1/16* (2013.01); *F01M 11/12* (2013.01); *F25B 9/008* (2013.01); *F01M 1/02* (2013.01); *F01M 2001/1071* (2013.01); *F25B 2500/16* (2013.01)

(58) Field of Classification Search

CPC ..... F25B 43/02; F25B 9/008; F25B 2500/16; F01M 1/10; F01M 1/16; F01M 11/12; F01M 1/02; F01M 2001/1071

See application file for complete search history.

(56) References Cited

FOREIGN PATENT DOCUMENTS

| | | | |
|---|---|---|---|
| JP | 2009109057 A | * | 5/2009 |
| JP | 2014181755 A | * | 9/2014 |
| JP | 2023037294 A | | 3/2023 |

OTHER PUBLICATIONS

Hayashi et al., Cooling System and its Starting Method, May 21, 2009, JP2009109057A, Whole Document (Year: 2009).*

(Continued)

*Primary Examiner* — Larry L Furdge

(74) *Attorney, Agent, or Firm* — Alleman Hall LLP

(57) ABSTRACT

A refrigerant circulation system configured to circulate oil-containing $CO_2$ refrigerant includes a compressor, a motor, an oil tank, first to third passages, a flow regulating valve provided to the first and/or second passages, a motor rotational speed sensor, and a controller which controls the flow regulating valve(s). The refrigerant supplied from the compressor flows through the first passage, the oil supplied from the oil tank flows through the second passage. The motor includes a rotation shaft coupled to a rotor, and slide bearings which are lubricated using liquefied refrigerant compressed by the compressor and support the rotation shaft. The third passage communicates the first passage with the second passage and supplies to the slide bearings the refrigerant mixed with the oil. The controller controls the flow regulating valve according to the detected rotational speed to change a proportion of the oil in the refrigerant supplied to the slide bearings.

20 Claims, 7 Drawing Sheets

(51) Int. Cl.
*F25B 9/00* (2006.01)
*F01M 1/02* (2006.01)

(56) References Cited

OTHER PUBLICATIONS

Kotsuji, Lubricating Flow Quantity Control Device . . . , Sep. 29, 2014, JP2014181755A, Whole Document (Year: 2014).*

* cited by examiner

REFRIGERANT CIRCULATION SYSTEM

TECHNICAL FIELD

The present disclosure relates to a refrigerant circulation system which circulates refrigerant containing oil.

BACKGROUND OF THE DISCLOSURE

Conventionally, refrigerant circulation systems which circulate refrigerant via components, such as a compressor and a heat exchanger, in a refrigeration cycle used for air conditioners are used. In recent years, such refrigerant circulation systems are used for cooling components in a vehicle (e.g., a battery of an electric vehicle or a hybrid car). One of the examples is disclosed in JP2023-037294A, which is a vehicle for achieving downsizing and cost down of the system by sharing one compressor and supplying refrigerant which flowed out of the compressor to the air conditioner or the battery.

Meanwhile, rolling bearings and slide bearings are used conventionally to support a rotation shaft of power sources (e.g., an engine and a motor) of a vehicle. Here, if the rolling bearings are applied to the motor of an electric vehicle, since the rotation shaft of the motor rotates at high rotational speed (e.g., over 30,000 rpm), this poses a problem for the longevity of the bearings due to rolling fatigue. On the other hand, if ordinary slide bearings using oil as lubricant are applied to the motor, significant losses may occur due to oil agitation resistance acting against the rotation shaft.

SUMMARY OF THE DISCLOSURE

Therefore, the present inventors considered applying a motor to such a refrigerant circulation system, and applying slide bearings using refrigerant which circulates this system (especially, $CO_2$ refrigerant which becomes liquefied by compression of a compressor) as lubricant to a rotation shaft of the motor. In addition, the present inventors considered making this motor function as a part of a refrigeration cycle according to the refrigerant circulation system (in detail, making it function as an expansion valve and an evaporator of the refrigeration cycle).

Here, although in the common refrigerant circulation system the refrigerant containing oil (e.g., freezer oil) for lubricating and sealing the compressor is used, it is desirable to use the refrigerant containing oil also in the system in which the refrigerant lubricates the slide bearings of the motor in order to secure the lubricity of the slide bearings. However, in this case, it is thought that the necessity for the oil in the refrigerant for lubricating the slide bearings varies according to the operating state of the motor. When the motor rotational speed is comparatively low, since the load capability of the slide bearings is lowered, the necessity for the oil in the refrigerant becomes higher in order to secure the load capability of the bearings. On the other hand, when the motor rotational speed is comparatively high, since the load capability of the slide bearings is secured by the wedge effect and the diaphragm effect, and the loss due to the resistance of the oil tends to increase, the necessity for the oil in the refrigerant becomes lower. Therefore, the present inventors considered controlling a proportion of the oil in the refrigerant (corresponding to the viscosity of the refrigerant) according to the motor rotational speed.

Therefore, the present disclosure is made in order to solve the problems of the conventional technology described above, and one purpose thereof is to provide a refrigerant circulation system, which circulates refrigerant containing oil and lubricates slide bearings of a motor with the refrigerant, capable of accurately changing a proportion of the oil in the refrigerant according to a motor rotational speed.

A refrigerant circulation system configured to circulate refrigerant in which $CO_2$ contains oil is provided. The system includes a compressor configured to compress the refrigerant, a motor provided with a rotor and a stator, a rotation shaft coupled to the rotor, and slide bearings configured to be lubricated using liquefied refrigerant compressed by the compressor and support the rotation shaft, an oil tank configured to store the oil, a first passage through which the refrigerant supplied from the compressor flows, a second passage through which the oil supplied from the oil tank flows, and a third passage communicating the first passage with the second passage and configured to supply to the slide bearings of the motor the refrigerant from the first passage mixed with the oil from the second passage, at least one flow regulating valve provided to at least one of the first passage and the second passage, a motor rotational speed sensor configured to detect a rotational speed of the motor, and a controller configured to control the at least one flow regulating valve. The controller controls the at least one flow regulating valve according to the rotational speed detected by the motor rotational speed sensor to change a proportion of the oil in the refrigerant supplied from the third passage to the slide bearings.

According to this configuration, the controller controls the flow regulating valve provided in the first passage through which refrigerant from the compressor flows and/or the second passage through which oil from the oil tank flows, thereby allowing the controller to appropriately vary the oil content in the refrigerant used to lubricate the slide bearings (corresponding to the viscosity of the refrigerant) in accordance with the operating conditions of the motor. For example, the controller can increase the oil content when the motor rotation speed is relatively low, and decrease the oil content when the motor rotation speed is relatively high. In this way, according to this configuration, it is possible to both ensure the load capacity of the slide bearings and reduce friction of the slide bearings (reduce lubrication resistance) depending on the operating conditions of the motor.

The controller may control the at least one flow regulating valve to increase the proportion of the oil as the rotational speed decreases. In this manner, when the motor rotation speed is relatively low, a refrigerant containing a sufficient amount of oil can be supplied to the slide bearings to ensure the load capacity of the slide bearings. On the other hand, when the motor rotation speed is relatively high, a refrigerant with a reduced oil content can be supplied to the slide bearings to reduce friction caused by oil in the sliding bearing.

The controller may control the at least one flow regulating valve to adjust the proportion of the oil so that load capability of the slide bearings becomes substantially constant, regardless of the rotational speed. In this manner, it is possible to effectively achieve both ensuring the load capacity of the slide bearings and reducing friction in the slide bearings.

The at least one flow regulating valve may include a refrigerant flow regulating valve provided to the first passage, and an oil flow regulating valve provided to the second passage. The controller may decrease an opening of the refrigerant flow regulating valve and increase an opening of the oil flow regulating valve as the rotational speed decreases so that the proportion of the oil increases. In this manner, by controlling the opening of the refrigerant flow regulating valve and the oil flow regulating valve, it is possible to reliably supply a refrigerant containing a sufficient amount of oil to the slide bearings when the motor rotation speed is low, and effectively ensure the load capacity of the slide bearings.

When starting the motor, the controller may fully close the refrigerant flow regulating valve and fully open the oil flow regulating valve. In this manner, a refrigerant with a very high oil content can be supplied when the motor is started, when the load capacity of the slide bearings becomes very small, making it possible to effectively ensure the load capacity of the slide bearings.

The refrigerant circulation system may further include a fourth passage for supplying the refrigerant flowing out of the motor to the compressor. The oil tank may be provided to the fourth passage and separate the oil contained in the refrigerant from the refrigerant and stores the separated oil. In this manner, the oil can be appropriately collected from the refrigerant after use in the motor and stored in the oil tank.

The refrigerant circulation system may further include an oil level sensor configured to detect an oil level of the oil stored in the oil tank. When the oil level detected by the oil level sensor is below a given value, the controller may issue a notification regarding the oil level being below the given value and stop the motor. In this manner, when there is not enough oil stored in the oil tank, problems that may occur due to a lack of oil can be reliably prevented in advance.

The refrigerant circulation system may further include an oil pump provided to the second passage and configured to pump the oil stored in the oil tank.

DETAILED DESCRIPTION OF THE DISCLOSURE

Hereinafter, a refrigerant circulation system according to one embodiment is described with reference to the accompanying drawings.

Overall Configuration

Figure 1:
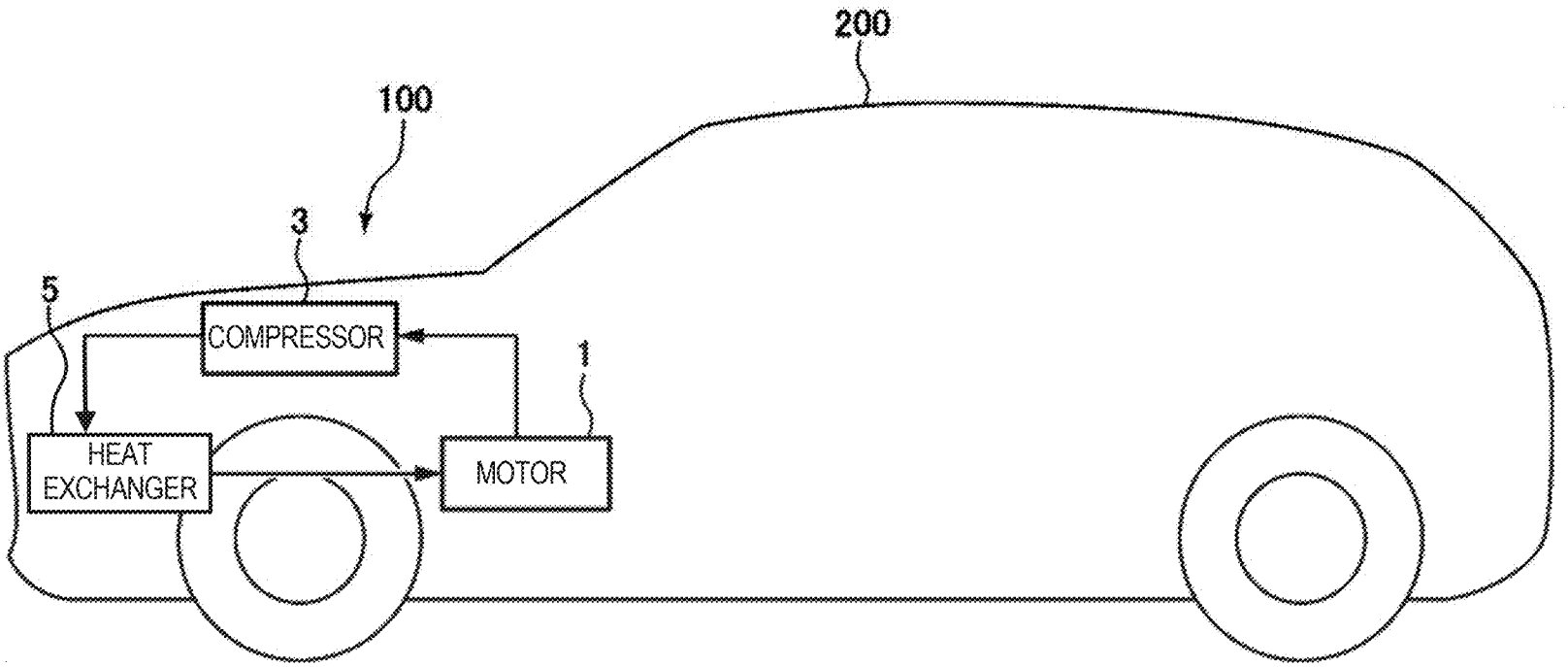
FIG. 1 is a schematic view of a vehicle to which a refrigerant circulation system according to one embodiment of the present disclosure is applied.

First, referring to FIG. 1, the overall configuration of the refrigerant circulation system according to this embodiment is described. FIG. 1 is a schematic view of a vehicle to which the refrigerant circulation system according to this embodiment is applied.

As illustrated in FIG. 1, a vehicle 200 is, for example, an electric vehicle with a refrigerant circulation system 100 which circulates refrigerant in a refrigeration cycle. The refrigerant circulation system 100 has a motor 1 which generates motive force to propel the vehicle 200, a compressor 3 for compressing the refrigerant to be supplied to the motor 1, and a heat exchanger 5 which includes a condenser and a fan, and cools the refrigerant compressed by the compressor 3.

The refrigerant circulation system 100 circulates $CO_2$ refrigerant as natural refrigerant. Therefore, the compressor 3 is configured to compress the refrigerant into very high pressure. The motor 1 uses the liquefied (typically, super-critical state) refrigerant, which is compressed by the compressor 3 in this way, to lubricate slide bearings which support a rotation shaft, and cool a rotor and a stator to function as an expansion valve and an evaporator in a refrigeration cycle (described later in detail). For example, in the refrigerant circulation system 100, high-temperature and high-pressure refrigerant is supplied from the compressor 3 to the heat exchanger 5, ordinary-temperature high-pressure super-critical refrigerant is then supplied from the heat exchanger 5 to the motor 1, and the ordinary-temperature low-pressure gas refrigerant is then supplied from the motor 1 to the compressor 3. In this case, the cooling inside the motor 1 is performed by latent heat of vaporization of the refrigerant. Note that such refrigerant which circulates through the refrigerant circulation system 100 may be shared with an air conditioner which performs air conditioning inside the vehicle 200.

In particular, the refrigerant circulation system 100 circulates refrigerant in which $CO_2$ contains oil (e.g., freezer oil, such as polyalkyline glycol (PAG), which also typically includes additives). Such oil is easily dissolved into the refrigerant in liquid phase, and the solubility (and therefore also the proportion) of the oil becomes larger as the pressure of the refrigerant increases. On the other hand, the oil barely dissolves into the refrigerant in a gaseous phase.

[Configuration of Motor]

Figure 2:
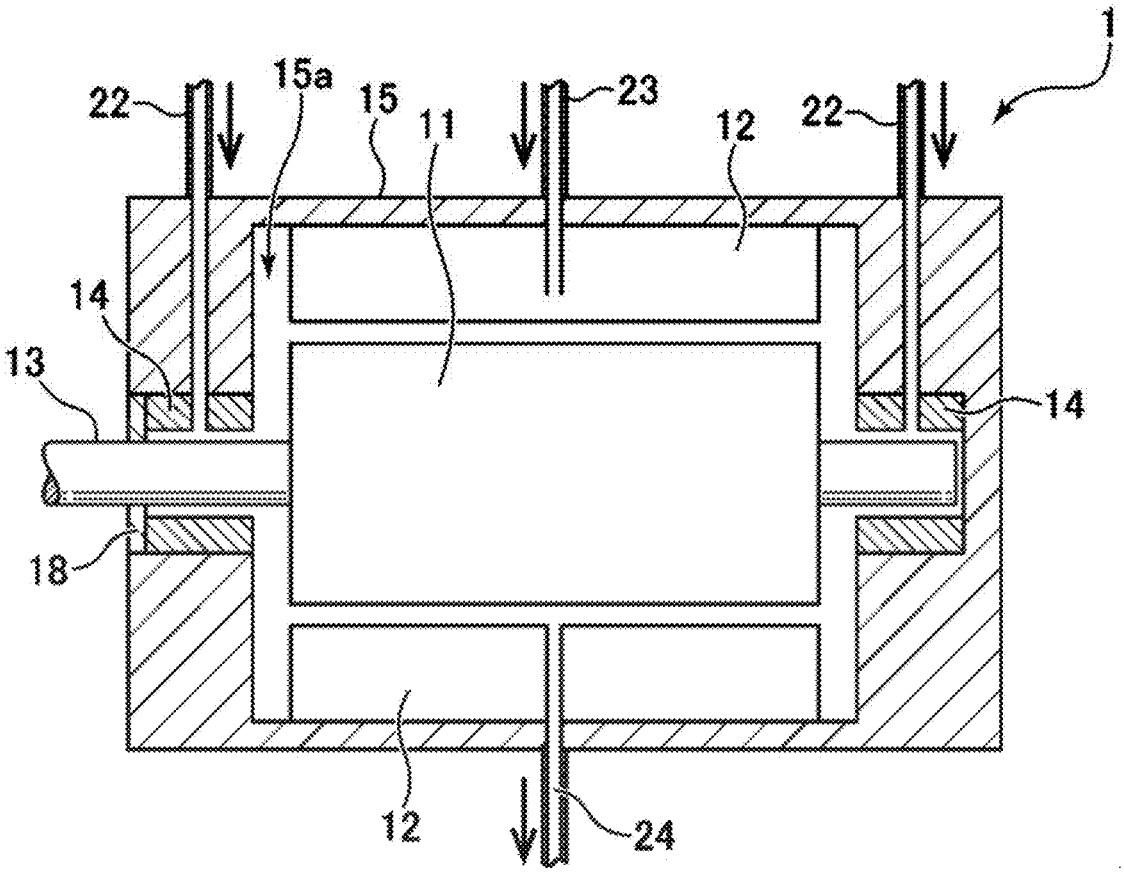
FIG. 2 is a schematic view of a motor according to this embodiment.

Next, referring to FIG. 2, a configuration of the motor 1 according to this embodiment is described. FIG. 2 is a schematic view of the motor 1 according to this embodiment, which is also a cross-sectional view of the motor 1 in the axial direction.

As illustrated in FIG. 2, the motor 1 is a system which mainly has a rotor 11 and a stator 12, a rotation shaft 13 which is coupled to the rotor 11 and is connected at one end to a transaxle (not illustrated) of the vehicle 200, a pair of slide bearings 14 which support the rotation shaft 13, and a housing 15 which accommodates the rotor 11, the stator 12, the rotation shaft 13, and the slide bearings 14.

In the motor 1, the refrigerant compressed by the compressor 3 is supplied to each of the slide bearings 14 and the stator 12 via refrigerant passages 22 and 23. In detail, the refrigerant passages 22 supply the refrigerant to gaps between the rotation shaft 13 and the slide bearings 14. The slide bearings 14 are lubricated using the refrigerant ($CO_2$ refrigerant) supplied from the refrigerant passages 22 as lubricant. In this case, the slide bearings 14 are lubricated using the liquefied refrigerant (in detail, the refrigerant containing $CO_2$ in the supercritical state).

Here, if rolling bearings are applied to the motor 1, since the rotation shaft 13 of the motor 1 rotates at a high rotational speed (e.g., over 30,000 rpm) in the electric vehicle, this poses a problem for the longevity of the bearings due to rolling fatigue. On the other hand, if general slide bearings using oil are applied to the motor 1, significant losses may occur due to oil agitation resistance acting against the rotation shaft 13. Therefore, in this embodiment the slide bearings 14 using the refrigerant which becomes liquefied (supercritical state) by the compression of the compressor 3 are applied to the motor 1. Therefore, the problems, such as the rolling fatigue and the oil agitation resistance, can be solved.

Further, the refrigerant supplied from the refrigerant passage 23 is used for cooling the stator 12 (in detail, cooling a coil (not illustrated) of the stator 12). The refrigerant used for cooling the stator 12 and the refrigerant used for lubricating the slide bearings 14 in this way flows out of a refrigerant passage 24, and is then returned to the compressor 3 (FIG. 1). Note that the refrigerant after being used for the lubrication of the slide bearings 14 is also supplied to the stator 12 to be used for cooling the stator 12.

Such a motor 1 functions as an expansion valve in the refrigeration cycle because the refrigerant is supplied from the gaps between the rotation shaft 13 and the slide bearings 14 to a space 15*a* inside the housing 15 where the rotor 11 and the stator 12 are provided and is decompressed, and also functions as an evaporator in the refrigeration cycle because the refrigerant exchanges heat with the comparatively-hot stator 12 (the refrigerant evaporates at the coil of the stator 12).

Further, the motor 1 further has a sealing member 18 for sealing the rotation shaft 13 at one side which is connected to the transaxle. This sealing member 18 is provided to prevent leakage of the refrigerant from the gap between the rotation shaft 13 and the housing 15 to the outside. On the other hand, such a sealing member 18 is not provided at the opposite end part from the side of the rotation shaft 13 connected to the transaxle, but this side is sealed by being covered with the housing 15.

[Concrete Configuration of Refrigerant Circulation System]

Figure 3:
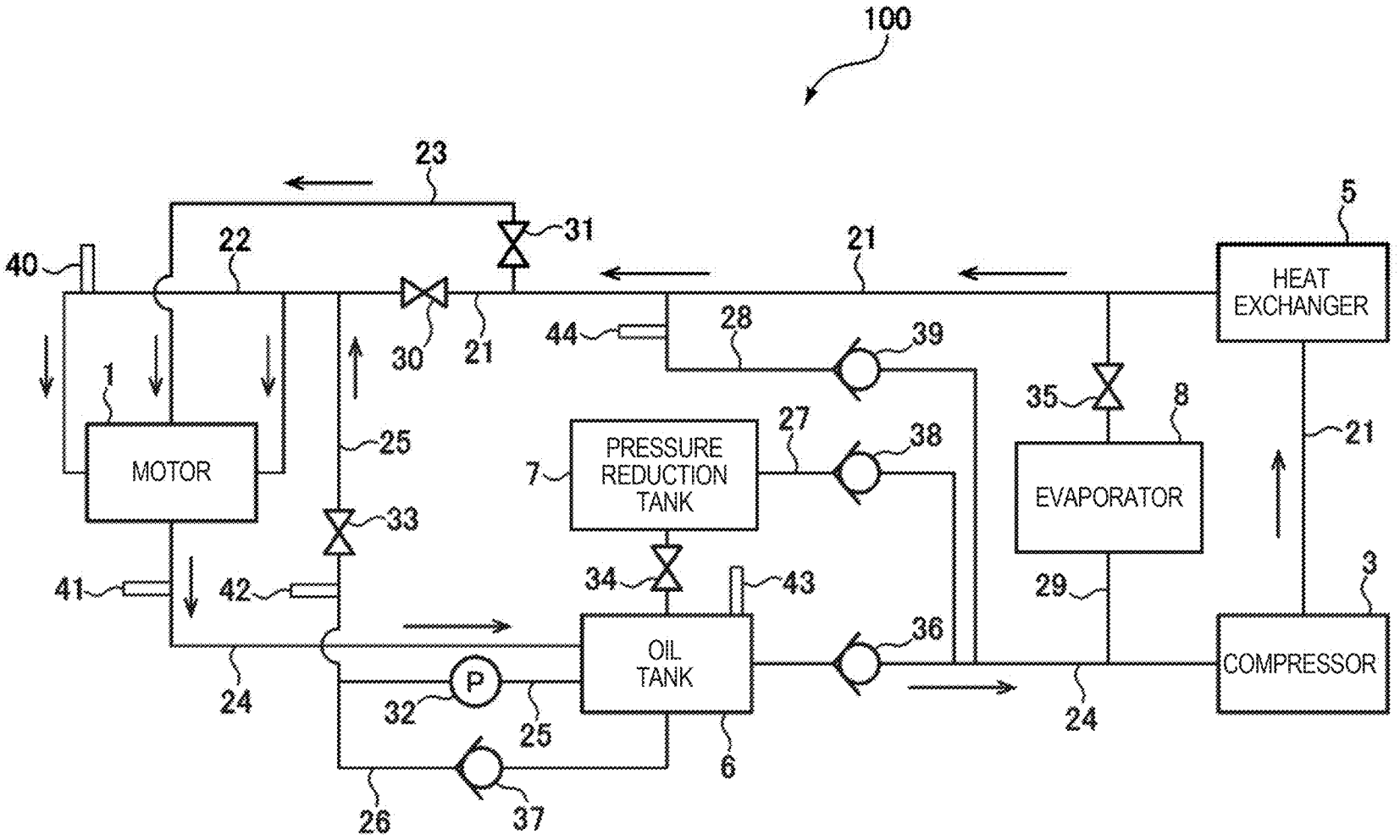
FIG. 3 is a schematic view of the refrigerant circulation system according to this embodiment.

Next, referring to FIG. 3, the refrigerant circulation system 100 according to this embodiment is described concretely. FIG. 3 is a schematic view of the refrigerant circulation system 100 according to this embodiment.

As illustrated in FIG. 3, the refrigerant circulation system 100 has, in addition to the motor 1, the compressor 3, and the heat exchanger 5 which are described above (FIG. 1), an oil tank 6 which stores the oil applied to the refrigerant, a pressure reduction tank 7 which stores negative pressure for decompressing or reducing pressure in the internal space 15*a* of the motor 1, and an evaporator 8 applied to the air conditioner in the vehicle 200. The refrigerant circulation system 100 further has, in addition to the refrigerant passages 22, 23, and 24 connected to the motor 1 (FIG. 2), refrigerant passages 21, 28, and 29 through which the refrigerant flows, oil passages 25 and 26 through which oil flows, and a pressure reduction passage 27 where the pressure reduction tank 7 performs the pressure reduction. Note that the refrigerant passage 21, the oil passage 25, the refrigerant passage 22, and the refrigerant passage 24 are examples of a "first passage," a "second passage," a "third passage," and a "fourth passage" in the present disclosure, respectively.

In detail, the refrigerant passage 21 is a passage for supplying the refrigerant from the compressor 3 to the motor 1 via the heat exchanger 5, and communicates with both the refrigerant passages 22 and 23. As described above, the refrigerant passage 22 is a passage for supplying the refrigerant to each slide bearing 14 of the motor 1, and the refrigerant passage 23 is a passage for supplying the refrigerant to the stator 12 of the motor 1 (FIG. 2). A first flow regulating valve 30 and a second flow regulating valve 31 which adjust a flow rate of the refrigerant which flows through the refrigerant passage 21 and the refrigerant passage 23 are provided to these passages, respectively. In more detail, the first flow regulating valve 30 is provided to the refrigerant passage 21, between a connection with the refrigerant passage 22 and a connection with the refrigerant passage 23. A pressure sensor 40 which detects a pressure of the refrigerant is provided to the refrigerant passage 22. Note that the first flow regulating valve 30 is an example of a "refrigerant flow regulating valve" in the present disclosure.

The refrigerant passage 24 is a passage for supplying (recirculating) the refrigerant which flowed out of the motor 1 to the compressor 3, where a pressure sensor 41 which detects a pressure of the refrigerant passage 24, the oil tank 6 which stores the oil, and a one-way valve 36 are provided to the refrigerant passage 24. The pressure sensor 41 detects a pressure of the refrigerant upstream of the oil tank 6 (corresponding to the pressure inside the space 15*a* of the motor 1 and the pressure inside the oil tank 6). The oil tank 6 separates the oil in the refrigerant which flows through the refrigerant passage 24 (gas-liquid separation) from the oil and stores the separated oil, and the remaining refrigerant (which may slightly be including the oil) flows into the downstream compressor 3. An oil level sensor 43 which detects a level of the stored oil is provided to the oil tank 6.

The oil passage 25 is connected to the oil tank 6. The oil passage 25 is connected at one end to the oil tank 6, and is connected at the other end to the refrigerant passage 21 (in detail, it is connected to the refrigerant passage 21 downstream of the first flow regulating valve 30). The oil passage 25 supplies the refrigerant in which the oil is mixed with the refrigerant in the refrigerant passage 21 from the refrigerant passages 22 to the slide bearings 14 of the motor 1 by supplying the oil stored in the oil tank 6 to the refrigerant passage 21. In detail, an oil pump 32 which pumps the oil, an oil flow regulating valve 33 which adjusts a flow rate of the oil, and an oil pressure sensor 42 which detects oil pressure are provided to the oil passage 25. The oil passage 26 for returning the oil is further connected to the oil tank 6. Typically, the oil passage 26 functions to return the oil, which could not flow through the oil passage 25 when the oil flow regulating valve 33 is closed, to the oil tank 6 via a one-way valve (relief valve) 37.

The pressure reduction passage 27 is connected at one end to the oil tank 6 (in detail, it is connected to the refrigerant passage 24 via the oil tank 6), and is connected at the other end to the refrigerant passage 24 downstream of the oil tank 6. The pressure reduction tank 7, a pressure reduction valve 34, and a one-way valve 38 are provided to the pressure reduction passage 27. The pressure reduction tank 7 stores negative pressure, which is created by operation of the compressor 3, supplied via the pressure reduction passage 27 and the refrigerant passage 24 downstream (on the compressor 3 side) of the pressure reduction tank 7. The negative pressure stored in the pressure reduction tank 7 decompresses the internal space 15*a* of the motor 1 via the pressure reduction passage 27 and the refrigerant passage 24 upstream (on the oil tank 6 side) of the pressure reduction tank 7, when the pressure reduction valve 34 is opened. Note that the internal space 15*a* is a space inside the motor 1 (inside the housing 15) to which the refrigerant is supplied.

The refrigerant passage 28 is connected at one end to the refrigerant passage 21 upstream of the first and second flow regulating valves 30 and 31, and is connected at the other end to the refrigerant passage 24 downstream of the oil tank 6. A pressure sensor 44 which detects a pressure of the refrigerant and a one-way valve 39 are provided to the refrigerant passage 28. This refrigerant passage 28 functions to let the refrigerant which could not flow through the refrigerant passages 22 and 23 flow to the refrigerant passage 24 via the one-way valve (relief valve) 39, when the first and second flow regulating valves 30 and 31 are closed. Further, the refrigerant passage 29 is connected at one end to the refrigerant passage 21 upstream of the connection of the refrigerant passage 28, and is connected at the other end to the refrigerant passage 24 downstream of the connection of the refrigerant passage 28. The evaporator 8 and an expansion valve 35 which decompresses the refrigerant are provided to the refrigerant passage 29.

Figure 4:
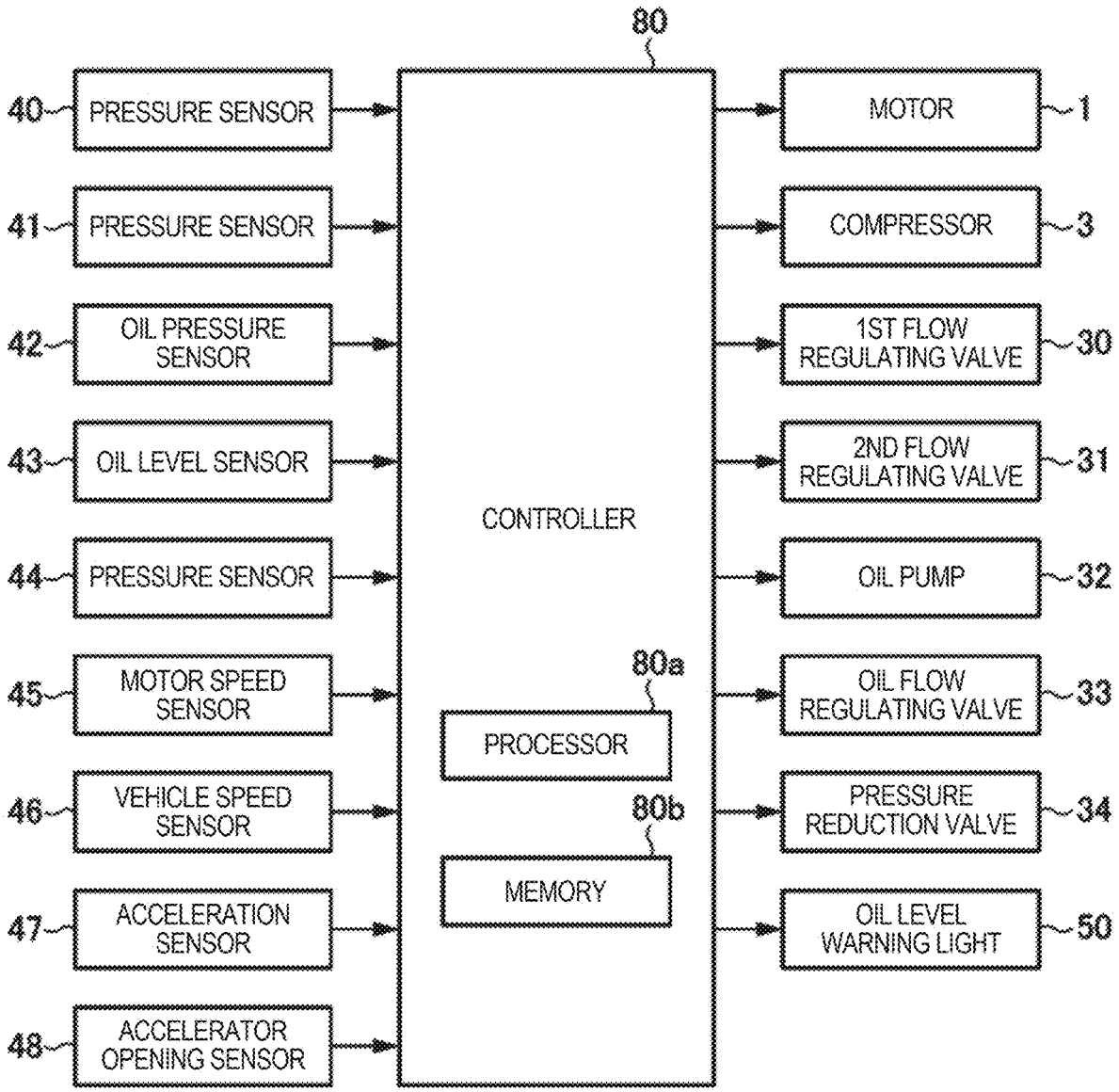
FIG. 4 is a block diagram illustrating an electric configuration of the refrigerant circulation system according to this embodiment.

Next, referring to FIG. 4, an electric configuration of the refrigerant circulation system 100 according to this embodiment is described. FIG. 4 is a block diagram illustrating the electric configuration of the refrigerant circulation system 100 according to this embodiment.

As illustrated in FIG. 4, the refrigerant circulation system 100 has a controller 80 configured to perform various controls of the system. The controller 80 is comprised of a computer provided with one or more processors 80*a* (typically, central processing unit(s) (CPU(s))), and memory 80*b* which includes read-only memory (ROM) and random access memory (RAM) and stores various kinds of programs which are interpreted and executed on the processor(s) 80*a* (including a primary control program, such as an operating system (OS), and an application program which runs on the OS and realizes a specific function) and various kinds of data.

The refrigerant circulation system 100 also has, in addition to the pressure sensors 40, 41, and 44, the oil pressure sensor 42, and the oil level sensor 43 which are described above, a motor rotational speed sensor 45 which detects a rotational speed of the motor 1 (it is a rotational speed of the rotor 11 and the rotation shaft 13, and is synonymous with the "motor (rotational) speed"), a vehicle speed sensor 46 which detects a speed (traveling speed) of the vehicle 200, an acceleration sensor 47 which detects an acceleration of the vehicle 200, and an accelerator opening sensor 48 which detects an accelerator opening corresponding to a stepping amount of an accelerator pedal of the vehicle 200.

The controller 80 supplies, based on detection signals from these sensors 40-48, a control signal to the motor 1, the compressor 3, the first and second flow regulating valves 30 and 31, the oil pump 32, the oil flow regulating valve 33, the pressure reduction valve 34, and an oil level warning light 50. Note that the oil level warning light 50 is a lamp for warning that a level of the oil stored in the oil tank 6 is below a given value (detected by the oil level sensor 43).

In this embodiment, the controller 80 controls, according to the motor rotational speed detected by the motor rotational speed sensor 45, the first and second flow regulating valves 30 and 31 and the oil flow regulating valve 33 to change the proportion of the oil (oil content) in the refrigerant supplied to the slide bearings 14 of the motor 1 (in other words, to change the viscosity of the refrigerant). In this case, the controller 80 decreases the openings of the first and second flow regulating valves 30 and 31 and increases the opening of the oil flow regulating valve 33 so that the oil content increases as the motor rotational speed decreases, and, on the other hand, it increases the openings of the first and second flow regulating valves 30 and 31 and decreases the opening of the oil flow regulating valve 33 so that the oil content decreases as the motor rotational speed increases.

[Contents of Control]

Figure 5:
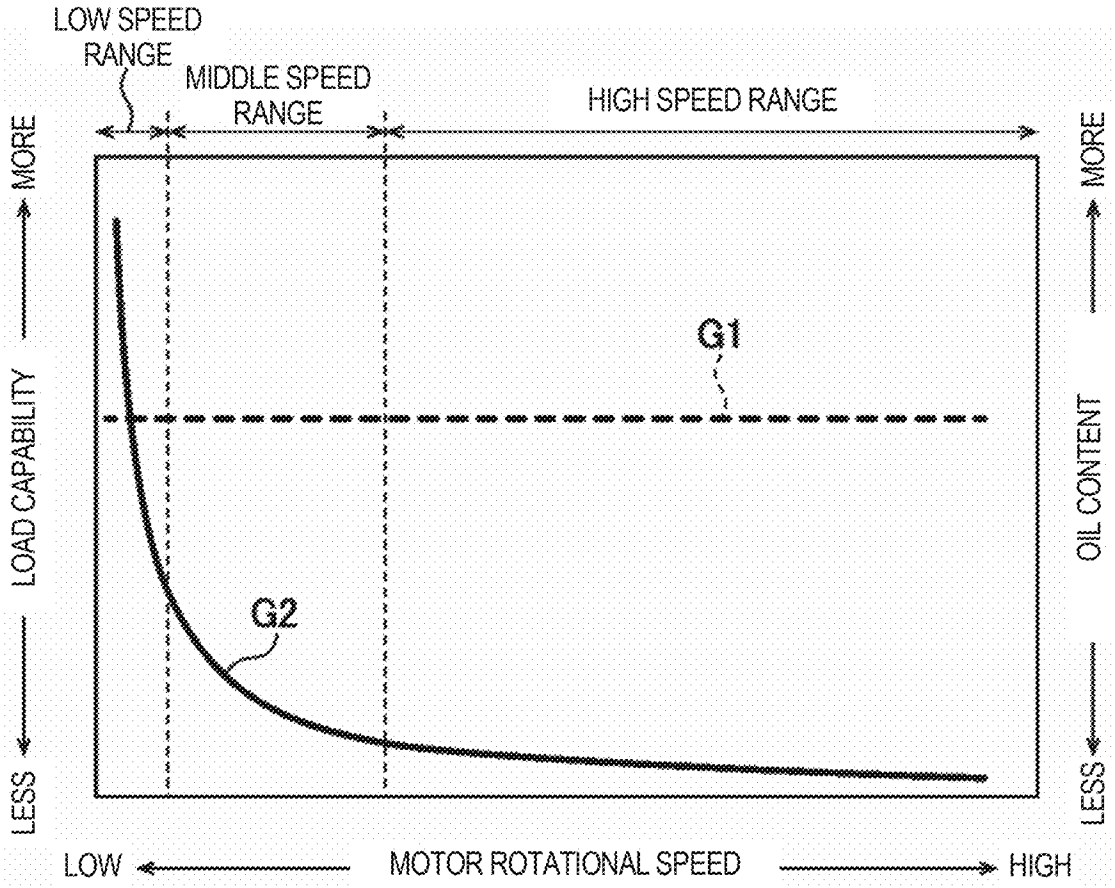
FIG. 5 is a diagram of the basic concept of a control according to this embodiment.

Next, in this embodiment, a control which the controller 80 of the refrigerant circulation system 100 performs is described concretely. First, referring to FIG. 5, the basic concept of this control is described. In FIG. 5, the horizontal axis indicates the motor rotational speed and the vertical axis indicates the load capability and the oil content of the slide bearings 14. Note that the load capability indicated in the vertical axis represented using a logarithm axis.

In FIG. 5, graph G1 indicates the load capability of the slide bearings 14 to be realized according to the motor rotational speed in this embodiment. Graph G1 indicates that the load capability of the slide bearings 14 is substantially constant, regardless of the motor rotational speed. In this embodiment, in order to realize the load capability of the slide bearings 14 as illustrated by graph G1, the controller 80 controls the first and second flow regulating valves 30 and 31 and the oil flow regulating valve 33 to change the oil content (i.e., the viscosity of the refrigerant) according to the motor rotational speed as illustrated by graph G2.

Graph G2 is a map where the oil content to be applied according to the motor rotational speed is defined. This map is defined to increase the oil content as the motor rotational speed decreases, and to decrease the oil content as the motor rotational speed increases. This is because the load capability of the slide bearings 14 decreases if the motor rotational speed is low. Then, in this case, it becomes necessary to apply a large amount of oil to the refrigerant in order to secure desired load capability. On the other hand, if the motor rotational speed is high, since the load capability of the slide bearings 14 can be secured by the wedge effect and the diaphragm effect, it will not be necessary to apply so much oil to the refrigerant. Especially, the map of Graph G2 is defined so that, in the low speed range (e.g., below 3,000 rpm), an absolute value of a rate of change in the oil content corresponding to the motor rotational speed becomes larger than the middle speed range (e.g., 3,000 rpm or above and below 10,000 rpm), and in the middle speed range, the absolute value of the rate of change in the oil content corresponding to the motor rotational speed becomes larger than the high speed range (e.g., 10,000 rpm or above). That is, this map is defined so that the absolute value of the rate of change in the oil content corresponding to the motor rotational speed increases as the motor rotational speed decreases, and the absolute value decreases as the motor rotational speed increases.

Figure 6:
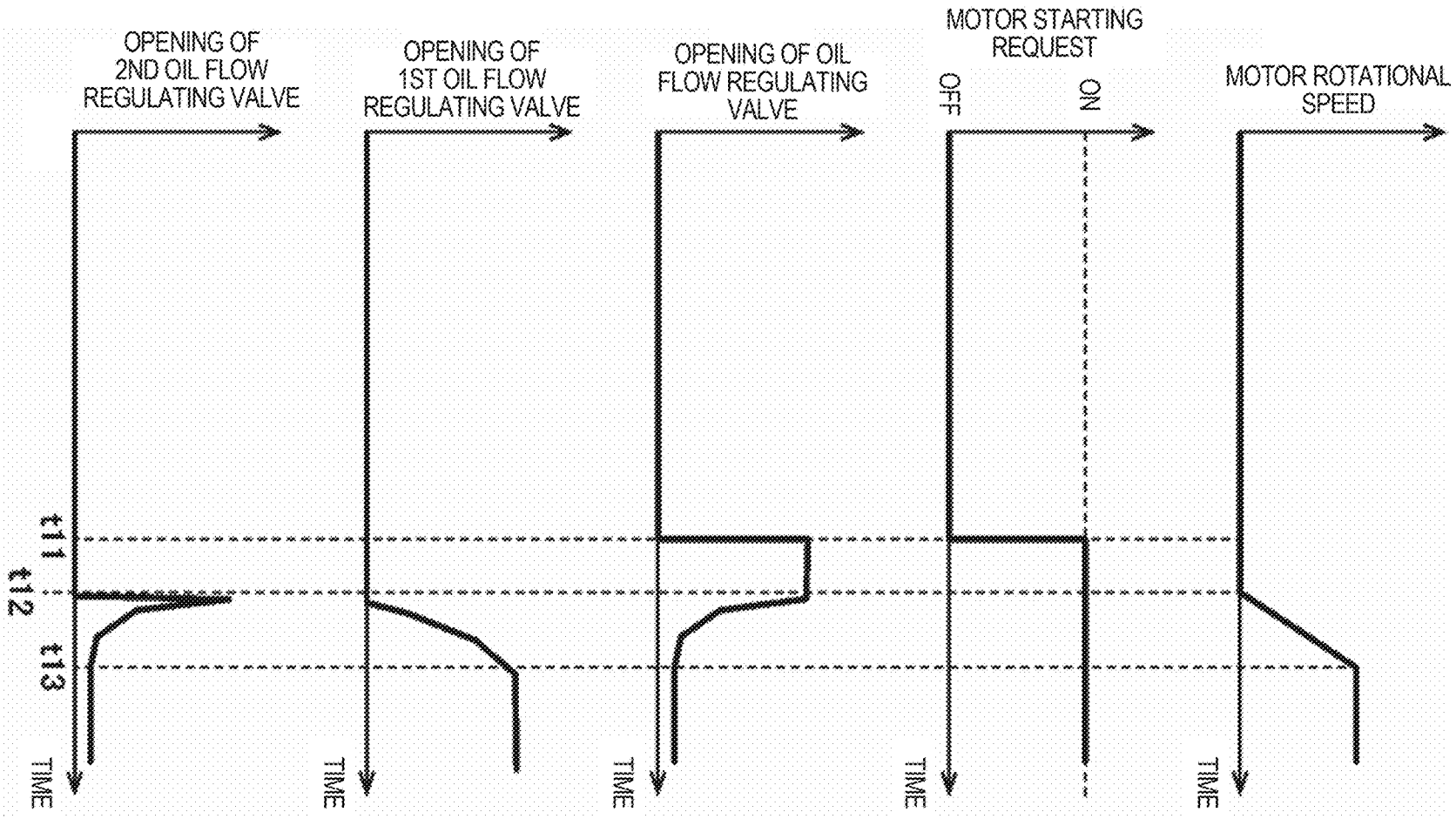
FIG. 6 is a time chart illustrating the control according to this embodiment.

Next, referring to FIG. 6, a flow of the control which the controller 80 performs in this embodiment is described. FIG. 6 is a time chart illustrating this control. FIG. 6 illustrates temporal changes in the motor rotational speed, a motor start request, an opening of the oil flow regulating valve 33, an opening of the first flow regulating valve 30, and an opening of the second flow regulating valve 31 in this order from top. Note that the motor start request is issued according to operation of a start switch and/or the accelerator pedal for starting the vehicle 200.

As illustrated in FIG. 6, at time t11, when a motor start request is issued, the controller 80 fully opens the oil flow regulating valve 33, while fully closing the first and second flow regulating valves 30 and 31. The controller 80 maintains the fully-open state of the oil flow regulating valve 33 and the fully-closed state of the first and second flow regulating valves 30 and 31 until the motor 1 actually starts (until time t12). Thus, when starting the motor 1 (in detail, from the issue of the motor start request until the rise of the motor rotational speed begins (time t11-t12), the refrigerant of which the oil content is 100% (high-viscosity refrigerant) is supplied to the slide bearings 14 of the motor 1.

Then, at time t12, the controller 80 starts the motor 1 to raise the motor rotational speed. From time t12, the controller 80 increases the opening of the first flow regulating valve 30, while decreasing the opening of the oil flow regulating valve 33, according to the rise of the motor rotational speed. Thus, according to the rise of the motor rotational speed, the refrigerant where the oil content deceases (the refrigerant of which the viscosity decreases) is supplied to the slide bearings 14 of the motor 1. On the other hand, at Time t12, the controller 80 once sharply raises the opening of the second flow regulating valve 31 and then sharply lowers the opening of the second flow regulating valve 31 immediately after that. Further, at time t13 after time t12, the controller 80 fixes the motor rotational speed, and maintains the openings of the oil flow regulating valve 33 and the first and second flow regulating valves 30 and 31.

Figure 7:
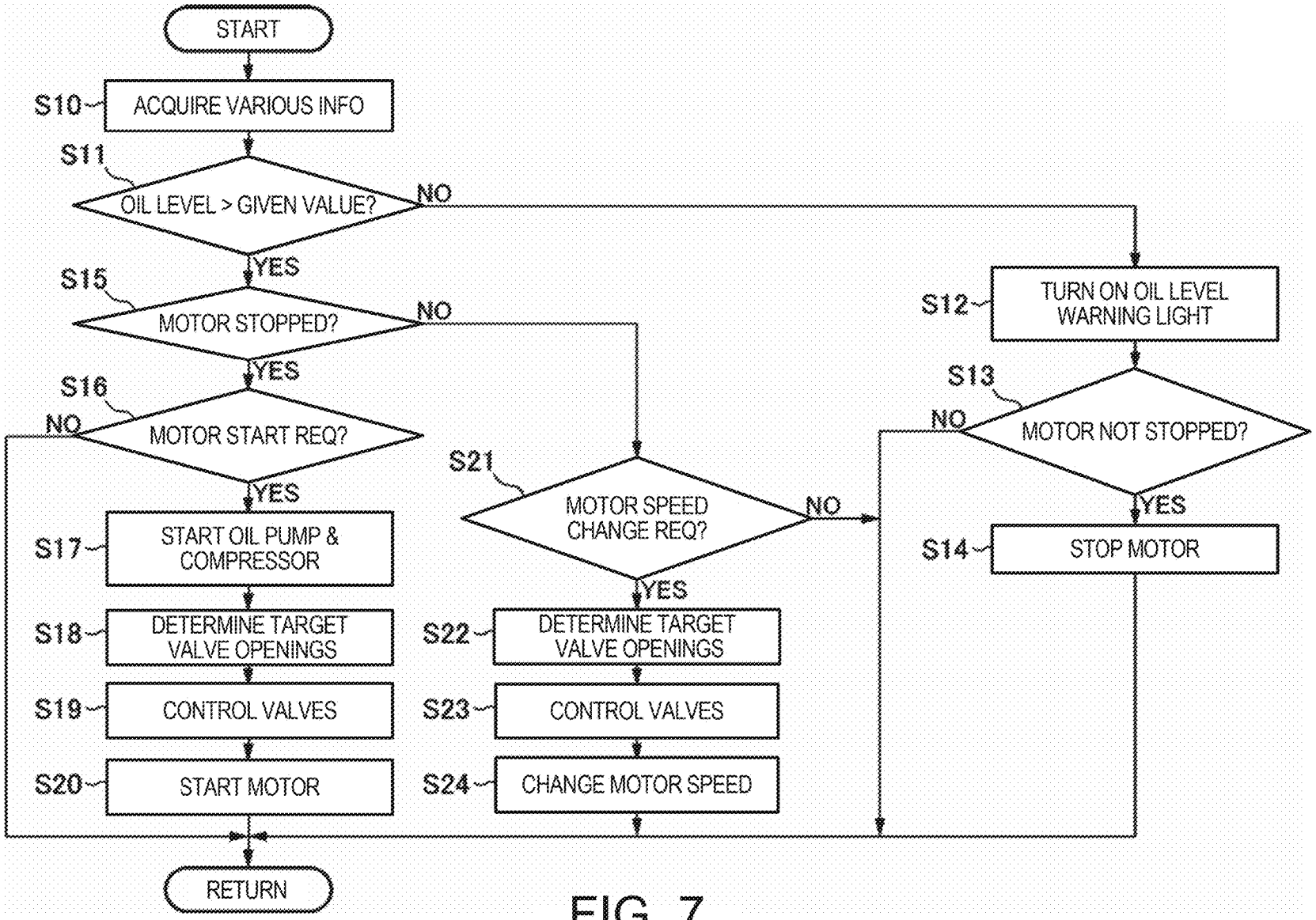
FIG. 7 is a flowchart illustrating the control according to this embodiment.

Next, referring to FIG. 7, a flowchart illustrating the concrete control according to this embodiment is described. This flow is repeatedly performed at a given cycle by the controller 80. In detail, the control according to this flow is realized by the processor(s) 80*a* in the controller 80 reading and executing the program stored in the memory 80*b*.

First, at Step S10, the controller 80 acquires varieties of information, such as the detection values detected by the above-described sensors 40-48 (FIG. 4). Then, the controller 80 transitions to Step S11, where it determines whether the oil level detected by the oil level sensor 43 is above the given value. As a result, if the controller 80 does not determine that the oil level is above the given value (i.e., if the oil level is below the given value) (Step S11: No), the controller 80 transitions to Step S12, where it turns on the oil level warning light 50.

Then, the controller 80 transitions to Step S13, where it determines based on the motor rotational speed detected by the motor rotational speed sensor 45 whether the motor 1 is not currently stopped. As a result, if the controller 80 determines that the motor 1 is not currently stopped (i.e., if the motor 1 is operating) (Step S13: Yes), the controller 80 transitions to Step S14, where it stops the motor 1. Then, the controller 80 ends the control according to this flow. On the other hand, if the controller 80 does not determine that the motor 1 is not currently stopped (i.e., if the motor 1 has already been stopped) (Step S13: No), the controller 80 ends the control according to this flow.

On the other hand, at Step S11, if the controller 80 determines that the oil level is above the given value (Step S11: Yes), the controller 80 transitions to Step S15. At Step S15, the controller 80 determines whether the motor 1 is currently stopped based on the motor rotational speed detected by the motor rotational speed sensor 45. As a result, if the controller 80 determines that the motor 1 is currently stopped (Step S15: Yes), the controller 80 transitions to Step S16, where it then determines based on the start switch of the vehicle 200 and the accelerator opening detected by the accelerator opening sensor 48 whether the motor start request is issued. As a result, if the controller 80 determines that the motor start request is issued (Step S16: Yes), it transitions to Step S17. At Step S17, the controller 80 starts the oil pump 32 and the compressor 3. On the other hand, if the controller 80 does not determine that the motor start request is issued (Step S16: No), it ends the control according to this flow.

Then, the controller 80 transitions to Step S18, where it determines the openings of the oil flow regulating valve 33 and the first and second flow regulating valves 30 and 31. The controller 80 sets a target rotational speed according to the accelerator opening, etc. For example, the controller 80 obtains a demanded viscosity of the refrigerant supplied to the slide bearings 14 of the motor 1 (i.e., a demanded oil content) based on the target rotational speed, etc. of the motor 1, and determines a target opening of each valve according to the demanded viscosity. In a typical example, the controller 80 sets the demanded viscosity of the oil as a viscosity corresponding to the oil content of 100% to fully open the opening of the oil flow regulating valve 33 and to fully close the openings of the first and second flow regulating valves 30 and 31.

Next, the controller 80 transitions to Step S19, where it controls the oil flow regulating valve 33 and the first and second flow regulating valves 30 and 31 to achieve the target openings determined at Step S18. Then, the controller 80 transitions to Step S20, where it starts the motor 1 and then ends the control according to this flow.

On the other hand, at Step S15, if the controller 80 does not determine that the motor 1 is currently stopped (i.e., if the motor 1 is operating) (Step S15: No), the controller 80 transitions to Step S21. At Step S21, the controller 80 determines whether a change request of the motor (rotational) speed is issued based on the accelerator opening detected by the accelerator opening sensor 48. Note that the change request of the motor rotational speed also includes a stop request of the motor 1. As a result of Step S21, if the controller 80 determines that the change request of the motor rotational speed is issued (Step S21: Yes), it transitions to Step S22, and, on the other hand, if the controller 80 does not determine that the change request of the motor rotational speed is issued (Step S21: No), it ends the control according to this flow.

At Step S22, the controller 80 determines target openings of the oil flow regulating valve 33 and the first and second flow regulating valves 30 and 31. For example, the controller 80 obtains the demanded viscosity of the refrigerant (i.e., the demanded oil content) to be supplied to the slide bearings 14 of the motor 1 based on the motor rotational speed (target rotational speed) to be changed, and determines the opening of each valve according to the demanded viscosity. Fundamentally, the controller 80 sets a smaller demanded viscosity as the motor rotational speed increases. In this way, when the small demanded viscosity is set according to the motor rotational speed, the controller 80 at least determines a comparatively small value for the opening of the oil flow regulating valve 33, and a comparatively large value for opening of the first flow regulating valve 30.

Next, the controller 80 transitions to Step S23, where it controls the oil flow regulating valve 33 and the first and second flow regulating valves 30 and 31 so that their openings are set to the target openings determined at Step S22. Then, the controller 80 transitions to Step S24, where it controls the motor 1 to change the motor rotational speed, and then ends the control according to this flow.

Operation and Effects

Next, operation and effects of the refrigerant circulation system 100 according to this embodiment are described.

In this embodiment, the refrigerant circulation system 100 which circulates refrigerant in which $CO_2$ contains oil ($CO_2$ refrigerant) has:

- the compressor 3 which compresses the refrigerant;
- the motor 1 including the rotor 11 and the stator 12, the rotation shaft 13 coupled to the rotor 11, and the slide bearings 14 which support the rotation shaft 13 and are lubricated using the liquefied refrigerant compressed by the compressor 3;
- the oil tank 6 which stores the oil;

the refrigerant passage 21 through which the refrigerant supplied from the compressor 3 flows, the oil passage 25 through which the oil supplied from the oil tank 6 flows, and the refrigerant passages 22 which communicates the refrigerant passage 21 with the oil passage 25 and supplies to the slide bearing 14 the refrigerant in which the refrigerant from the refrigerant passage 21 is mixed with the oil from the oil passage 25;

the first flow regulating valve 30 and the oil flow regulating valve 33 which are provided to the refrigerant passage 21 and the oil passage 25, respectively;

the motor rotational speed sensor 45 which detects the motor rotational speed; and the controller 80 which controls the first flow regulating valve 30 and the oil flow regulating valve 33.

The controller 80 controls the first flow regulating valve 30 and the oil flow regulating valve 33 to change the oil content in the refrigerant supplied to the slide bearings 14 via the refrigerant passages 22 according to the motor rotational speed.

According to this embodiment, the controller 80 can suitably change the oil content in the refrigerant for lubricating the slide bearings 14 of the motor 1 (corresponding to the viscosity of the refrigerant) according to the operating state of the motor 1 by controlling the first flow regulating valve 30 and the oil flow regulating valve 33. Typically, when the motor rotational speed is comparatively low, the controller 80 can increase the proportion of the oil, and when the motor rotational speed is comparatively high, it can decrease the proportion of the oil. Therefore, when the motor rotational speed is comparatively low, the refrigerant containing the sufficient quantity of the oil can be supplied to the slide bearings 14 and the load capability of the slide bearings 14 can be secured, and when the motor rotational speed is comparatively high, the refrigerant where the oil content is reduced can be supplied to the slide bearings 14, and the friction due to the oil at the slide bearings 14 (lubrication resistance) can be reduced.

Further, according to this embodiment, the controller 80 decreases the opening of the first flow regulating valve 30 and increases the opening of the oil flow regulating valve 33 as the motor rotational speed decreases so that the oil content increases. Therefore, when the motor rotational speed is low, the refrigerant containing the sufficient quantity of the oil can be securely supplied to the slide bearings 14, and it becomes possible to effectively secure the load capability of the slide bearings 14.

Further, according to this embodiment, since the controller 80 adjusts the oil content so that the load capability of the slide bearings 14 becomes substantially constant, regardless of the rotational speed, both the securing of the load capability of the slide bearings 14 and the friction reduction of the slide bearings 14 can be effectively realized.

Further, according to this embodiment, when starting the motor 1, the controller 80 fully closes the first flow regulating valve 30 and fully opens the oil flow regulating valve 33. Therefore, when starting the motor 1 at which the load capability of the slide bearings 14 becomes very small, the refrigerant of which the oil content is very large can be supplied, and it becomes possible to effectively secure the load capability of the slide bearings 14.

Further, according to this embodiment, the refrigerant circulation system 100 further has the refrigerant passage 24 for supplying the refrigerant which flowed out of the motor 1 to the compressor 3. The oil tank 6 is provided to the refrigerant passage 24, and separates the oil contained in the refrigerant from the refrigerant and stores the oil. Therefore, the oil tank 6 can suitably collect and store the oil after being used by the motor 1 from the refrigerant.

According to this embodiment, the refrigerant circulation system 100 further has the oil level sensor 43 which detects the oil level of the oil stored in the oil tank 6. When the oil level detected by the oil level sensor 43 is below the given value, the controller 80 issue a notification regarding this event by way of the oil level warning light 50, and stops the motor 1. Therefore, in the situation where the sufficient oil is not stored in the oil tank 6, a problem which may be caused by the shortage of the oil can be securely prevented in advance. Note that the present disclosure is not limited to informing the driver that the oil level is below the given value by way of the oil level warning light 50, but a display image, sound, etc., may be used instead.

Modification(s)

In the above embodiment, the refrigerant circulation system 100 has the first flow regulating valve 30 and the oil flow regulating valve 33, and it controls the openings of both the valves to change the proportion of the oil. However, in other examples, the refrigerant circulation system 100 may only have one of the first flow regulating valve 30 and the oil flow regulating valve 33, and it may control the opening of this valve to change the proportion of the oil.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Motor
3 Compressor
5 Heat Exchanger
6 Oil Tank
7 Pressure Reduction Tank
11 Rotor
12 Stator
13 Rotation Shaft
14 Slide Bearing
21, 22, 23, 24 Refrigerant Passage
25 Oil Passage
27 Pressure Reduction Passage
30 First Flow Regulating Valve
31 Second Flow Regulating Valve
32 Oil Pump
33 Oil Flow Regulating Valve
34 Pressure Reduction Valve
43 Oil Level Sensor
80 Control Device
100 Refrigerant Circulation System
200 Vehicle

What is claimed is:

1. A refrigerant circulation system configured to circulate refrigerant in which $CO_2$ contains oil, the system comprising:

a compressor configured to compress the refrigerant;

a motor provided with a rotor and a stator, a rotation shaft coupled to the rotor, and slide bearings configured to be lubricated using liquefied refrigerant compressed by the compressor and support the rotation shaft;

an oil tank configured to store the oil;

a first passage through which the refrigerant supplied from the compressor flows, a second passage through which the oil supplied from the oil tank flows, and a third passage communicating the first passage with the second passage and configured to supply to the slide bearings of the motor the refrigerant from the first passage mixed with the oil from the second passage;

at least one flow regulating valve provided to at least one of the first passage and the second passage;

a motor rotational speed sensor configured to detect a rotational speed of the motor; and a controller configured to control the at least one flow regulating valve, wherein the controller controls the at least one flow regulating valve according to the rotational speed detected by the motor rotational speed sensor to change a proportion of the oil in the refrigerant supplied from the third passage to the slide bearings.

2. The refrigerant circulation system of claim 1, where the controller controls the at least one flow regulating valve to increase the proportion of the oil as the rotational speed decreases.

3. The refrigerant circulation system of claim 2, wherein the controller controls the at least one flow regulating valve to adjust the proportion of the oil so that load capability of the slide bearings becomes substantially constant, regardless of the rotational speed.

4. The refrigerant circulation system of claim 3, wherein the at least one flow regulating valve includes a refrigerant flow regulating valve provided to the first passage, and an oil flow regulating valve provided to the second passage, and wherein the controller decreases an opening of the refrigerant flow regulating valve and increases an opening of the oil flow regulating valve as the rotational speed decreases so that the proportion of the oil increases.

5. The refrigerant circulation system of claim 4, wherein, when starting the motor, the controller fully closes the refrigerant flow regulating valve and fully opens the oil flow regulating valve.

6. The refrigerant circulation system of claim 5, further comprising a fourth passage for supplying the refrigerant flowing out of the motor to the compressor, wherein the oil tank is provided to the fourth passage and separates the oil contained in the refrigerant from the refrigerant and stores the separated oil.

7. The refrigerant circulation system of claim 6, further comprising an oil level sensor configured to detect an oil level of the oil stored in the oil tank, wherein, when the oil level detected by the oil level sensor is below a given value, the controller issues a notification regarding the oil level being below the given value and stops the motor.

8. The refrigerant circulation system of claim 7, further comprising an oil pump provided to the second passage and configured to pump the oil stored in the oil tank.

9. The refrigerant circulation system of claim 1, wherein the controller controls the flow regulating valve to adjust the proportion of the oil so that load capability of the slide bearings becomes substantially constant, regardless of the rotational speed.

10. The refrigerant circulation system of claim 1, further comprising a fourth passage for supplying the refrigerant flowing out of the motor to the compressor, wherein the oil tank is provided to the fourth passage and separates the oil contained in the refrigerant from the refrigerant and stores the separated oil.

11. The refrigerant circulation system of claim 1, further comprising an oil level sensor configured to detect an oil level of the oil stored in the oil tank, wherein, when the oil level detected by the oil level sensor is below a given value, the controller issues a notification regarding the oil level being below the given value and stops the motor.

12. The refrigerant circulation system of claim 1, further comprising an oil pump provided to the second passage and configured to pump the oil stored in the oil tank.

13. The refrigerant circulation system of claim 2, wherein the flow regulating valve includes a refrigerant flow regulating valve provided to the first passage, and an oil flow regulating valve provided to the second passage, and wherein the controller decreases an opening of the refrigerant flow regulating valve and increases an opening of the oil flow regulating valve as the rotational speed decreases so that the proportion of the oil increases.

14. The refrigerant circulation system of claim 2, further comprising a fourth passage for supplying the refrigerant flowing out of the motor to the compressor, wherein the oil tank is provided to the fourth passage and separates the oil contained in the refrigerant from the refrigerant and stores the separated oil.

15. The refrigerant circulation system of claim 2, further comprising an oil level sensor configured to detect an oil level of the oil stored in the oil tank, wherein, when the oil level detected by the oil level sensor is below a given value, the controller issues a notification regarding the oil level being below the given value and stops the motor.

16. The refrigerant circulation system of claim 2, further comprising an oil pump provided to the second passage and configured to pump the oil stored in the oil tank.

17. The refrigerant circulation system of claim 9, wherein the flow regulating valve includes a refrigerant flow regulating valve provided to the first passage, and an oil flow regulating valve provided to the second passage, and wherein the controller decreases an opening of the refrigerant flow regulating valve and increases an opening of the oil flow regulating valve as the rotational speed decreases so that the proportion of the oil increases.

18. The refrigerant circulation system of claim 9, further comprising a fourth passage for supplying the refrigerant flowing out of the motor to the compressor, wherein the oil tank is provided to the fourth passage and separates the oil contained in the refrigerant from the refrigerant and stores the separated oil.

19. The refrigerant circulation system of claim 9, further comprising an oil level sensor configured to detect an oil level of the oil stored in the oil tank, wherein, when the oil level detected by the oil level sensor is below a given value, the controller issues a notification regarding the oil level being below the given value and stops the motor.

20. The refrigerant circulation system of claim 9, further comprising an oil pump provided to the second passage and configured to pump the oil stored in the oil tank.

* * * * *